US006997212B2

(12) United States Patent
Kawulka et al.

(10) Patent No.: US 6,997,212 B2
(45) Date of Patent: Feb. 14, 2006

(54) CHOKE VALVE WITH TEMPERATURE TRANSMITTER

(75) Inventors: Graham Ivan Kawulka, Edmonton (CA); Larry J. Bohaychuk, Mundare (CA)

(73) Assignee: Master Flo Valve Inc., Edmonton (CA)

( * ) Notice: Subject to any disclaimer, the term of this patent is extended or adjusted under 35 U.S.C. 154(b) by 277 days.

(21) Appl. No.: 10/698,991

(22) Filed: Oct. 31, 2003

(65) Prior Publication Data

US 2005/0115619 A1 Jun. 2, 2005

(51) Int. Cl.
*F16K 11/04* (2006.01)

(52) U.S. Cl. ..... 137/625.33; 137/551

(58) Field of Classification Search ..... 137/551, 137/625.3, 625.33

See application file for complete search history.

(56) References Cited

U.S. PATENT DOCUMENTS

| | | | | |
|---|---|---|---|---|
| 3,456,679 | A * | 7/1969 | Graham | 137/454.6 |
| 4,083,336 | A | 4/1978 | Armstrong et al. | 123/119 |
| 4,540,022 | A | 9/1985 | Cove | 137/625.3 |
| 5,431,188 | A | 7/1995 | Cove | 137/625.3 |
| 6,050,296 | A * | 4/2000 | Hoffmann et al. | 137/552 |
| 6,460,621 | B2 | 10/2002 | Fenton et al. | 166/347 |
| 6,484,800 | B2 * | 11/2002 | Carmody et al. | 137/625.33 |
| 6,536,473 | B2 | 3/2003 | Bohaychuk | 137/625.37 |
| 6,648,070 | B2 | 11/2003 | Cove et al. | 166/86.1 |
| 6,782,949 | B2 | 8/2004 | Cove et al. | 166/368 |
| 2003/0098151 | A1 | 5/2003 | Cove et al. | 166/86.1 |
| 2003/0141072 | A1 | 7/2003 | Cove et al. | 166/368 |

FOREIGN PATENT DOCUMENTS

GB 2 401 888 A 11/2004

* cited by examiner

*Primary Examiner*—John Fox
(74) *Attorney, Agent, or Firm*—Greenlee, Winner & Sullivan

(57) ABSTRACT

A choke valve useful for sub-sea application, having a valve body forming a bore extending therethrough which provides a body inlet, a body outlet and an insert chamber therebetween, and a removable insert assembly positioned in the insert chamber. The insert assembly includes a tubular cartridge having a side wall forming an internal bore and having a port communicating with the body inlet, whereby high pressure fluid enters through the body inlet; a bonnet connected with and closing the upper ends of the cartridge and the body, the bonnet being disengagably connected with the body, and a pressure reducing flow trim positioned in the cartridge bore, the flow trim having a restrictive opening whereby fluid from the body inlet may enter the flow trim at reduced pressure and pass through the body outlet. Further included is a temperature transmitter carried by the tubular cartridge, and having a temperature sensing component for measuring the temperature at a location in the tubular cartridge and for transmitting signals indicative thereof. Preferred are two temperature transmitters, the first located within the tubular cartridge and having a temperature sensing component located adjacent the body inlet, for measuring the temperature at body inlet and for transmitting signals indicative thereof; and the second located within the tubular cartridge and having a temperature sensing component located adjacent the body outlet, for measuring the temperature at the body outlet and for transmitting signals indicative thereof. Also preferred are one or more pressure transmitters for measuring the pressure across the choke valve.

7 Claims, 11 Drawing Sheets

CHOKE VALVE WITH TEMPERATURE TRANSMITTER

FIELD OF THE INVENTION

This invention relates to a choke valve particularly suited for use in sub-sea applications, having temperature sensing transmitters.

BACKGROUND OF THE INVENTION

A choke valve is a throttling device. It is commonly used as part of an oil or gas field wellhead. It functions to reduce the pressure of the fluid flowing through the valve. Choke valves are placed on the production "tree" of an oil or gas wellhead assembly to control the flow of produced fluid from a reservoir into the production flow line. They are used on wellheads located on land and offshore, as well as on wellheads located beneath the surface of the ocean.

Choke valves common to oil and gas field use are generally described in U.S. Pat. No. 4,540,022, issued Sep. 10, 1985, to Cove and U.S. Pat. No. 5,431,188, issued Jul. 11, 1995 to Cove. Both patents are commonly owned by Master Flo Valve, Inc., the assignee of the present application.

In general, chokes involve:

a valve body having an axial bore, a body inlet (typically referred to as a side outlet) and a body outlet (typically referred to as an end outlet);

a "flow trim" mounted in the bore between inlet and outlet, for throttling the flow moving through the body; and means for actuating the flow trim, said means closing the end of the bore remote from the outlet.

There are four main types of flow trim commonly used in commercial chokes. Each flow trim involves a port-defining member, a movable member for throttling the port, and seal means for implementing a total shut-off. These four types of flow trim can be characterized as follows:

(1) a needle-and-seat flow trim comprising a tapered annular seat fixed in the valve body and a movable tapered internal plug for throttling and sealing in conjunction with the seat surface;

(2) a cage-with-internal-plug flow trim, comprising a tubular, cylindrical cage, fixed in the valve body and having ports in its side wall, and a plug movable axially through the bore of the cage to open or close the ports. Shut-off is generally accomplished with a taper on the leading edge of the plug, which seats on a taper carried by the cage or body downstream of the ports;

(3) a multiple-port-disc flow trim, having a fixed ported disc mounted in the valve body and a rotatable ported disc, contiguous therewith, that can be turned to cause the two sets of ports to move into or out of register, for throttling and shut-off; and (4) a cage-with-external-sleeve flow trim, comprising a tubular cylindrical cage having ports in its side wall and a hollow cylindrical sleeve that slides axially over the cage to open and close the ports. The shut-off is accomplished with the leading edge of the sleeve contacting an annular seat carried by the valve body or cage.

In each of the above, the flow trim is positioned within the choke valve at the intersection of the choke valve's inlet and outlet. In most of the valves, the flow trim includes a stationary tubular cylinder referred to as a "cage", positioned transverse to the inlet and having its bore axially aligned with the outlet. The cage has restrictive flow ports extending through its sidewall. Fluid enters the cage from the choke valve inlet, passes through the ports and changes direction to leave the cage bore through the valve outlet.

Such a flow trim also includes a tubular throttling sleeve that slides over the cage. The sleeve acts to reduce or increase the area of the ports. An actuator, such as a threaded stem assembly, is provided to bias the sleeve back and forth along the cage. The rate that fluid passes through the flow trim is dependent on the relative position of the sleeve on the cage and the amount of port area that is revealed by the sleeve.

Maintenance on the deep sub-sea wellhead assemblies cannot be performed manually. An unmanned, remotely operated vehicle, referred to as an "ROV", is used to approach the wellhead and carry out maintenance functions. To aid in servicing sub-sea choke valves, choke valves have their internal components, including the flow trim, assembled into a modular sub-assembly. The sub-assembly is referred to as an "insert assembly" and is inserted into the choke valve body and clamped into position.

A typical prior art sub-sea choke valve 1 is shown in FIG. 1. It comprises a choke body 2 forming a T-shaped bore 3 that provides a horizontal inlet 4 (body inlet), a vertical bottom outlet 5 (body outlet) and an upper vertical component chamber 6 (insert chamber). A removable insert assembly 7 is positioned in the component chamber 6, extending transversely of the inlet 4. The insert assembly 7 includes a tubular cartridge 8, forming a side port 9, a flow trim 10 including a cage 11 and throttling sleeve 12, a collar assembly 13 and a bonnet 14. The bonnet 14 is disengagably clamped to the valve body 2. It closes the upper ends of the valve body 2 and the cartridge 8. The collar assembly 13 extends through the bonnet 14 into the cartridge bore 15 to bias the sleeve 12 along the cage 11 to throttle the restrictive flow ports 16.

The choke valve "sees" or experiences relatively high and relatively low fluid pressures. More particularly, the fluid flowing in through the valve body inlet 4 from the well (not shown) has a high pressure. When the fluid passes through the restrictive cage ports 16, it undergoes a considerable pressure drop. Thus, the fluid passing through the cage bore 17 and the valve body outlet 5 is at a lower pressure than that in the body inlet 4.

When the flow trim 10 becomes worn beyond its useful service life due to erosion and corrosion caused by particles and corrosive agents in the produced substances, an ROV is used to approach the choke valve 1, unclamp the insert assembly 7 from the choke valve body 2 and attach a cable to the insert assembly 7, so that it may be raised to the surface for replacement or repair. The ROV then installs a new insert assembly 7 and clamps it into position. This procedure eliminates the need to raise the whole wellhead assembly to the surface to service a worn choke valve.

In order to efficiently produce a reservoir, it is necessary to monitor the flow rate of the production fluid. This is done to ensure that damage to the formation does not occur and to ensure that well production is maximized. This process has been, historically, accomplished through the installation of pressure and temperature transmitters into the flow lines upstream and downstream of the choke valve. The sensor information is then sent to a remote location for monitoring, so that a choke valve controller can remotely bias the flow trim to affect the desired flow rate. The controller sends electrical signals to means, associated with the choke valve, for adjusting the flow trim.

A problem exists with this process due to the unreliable nature of these electronic sensors, which have a limited service life. Replacing the sensors after they have served their useful life has heretofore required that the whole wellhead assembly be raised to the surface. This is a time-consuming and costly operation that shuts down well production for the duration of the repair.

When dealing with 100 percent liquid flow upstream and downstream pressure data, combined with a calibrated choke valve is sufficient to determine flow rate. This is not the case when considering gaseous production fluids. Due to the highly compressible nature of gasses, temperature data is also required in order to determine the production flow rate. Currently, temperature sensors and transmitters for sub-sea choke valves are located somewhat distant (i.e., upstream and/or downstream) of the choke valve itself. U.S. Pat. No. 6,460,621, issued Oct. 8, 2002 to Fenton et al., describes a sub-sea wellhead which uses pressure and temperature sensors located upstream and downstream of the choke valve.

U.S. patent application Ser. No. 10/060,559/published as 2003/0141072 on Jul. 31, 2003, and assigned to Master Flo Valve Inc., describes a sub-sea choke valve with pressure transmitters. As indicated above, it is advantageous to also measure temperature at the choke valve in order to calculate the flow rate when considering gas flows.

There is still a need for a choke valve that eliminates the need to raise the sub-sea wellhead assembly to the surface to replace or repair temperature transmitters.

SUMMARY OF THE INVENTION

The invention provides a choke valve useful for sub-sea application, of the type having a valve body forming a bore extending therethrough which provides a body inlet, a body outlet and an insert chamber therebetween, and a removable insert assembly positioned in the insert chamber. The insert assembly includes a tubular cartridge having a side wall forming an internal bore and having a port communicating with the body inlet, whereby high pressure fluid enters through the body inlet; a bonnet connected with and closing the upper ends of the cartridge and the body, the bonnet being disengagably connected with the body, and a pressure reducing flow trim positioned in the cartridge bore, the flow trim having a restrictive opening whereby fluid from the body inlet may enter the flow trim at reduced pressure and pass through the body outlet. The valve further includes at least one temperature transmitter carried by the tubular cartridge, and having a temperature sensing component for measuring the temperature at a location in the tubular cartridge and for transmitting signals indicative thereof.

Preferably, the choke valve includes two temperature transmitters, a first temperature transmitter located within the tubular cartridge and having a temperature sensing component located adjacent the body inlet, for measuring the temperature at body inlet and for transmitting signals indicative thereof; and a second temperature transmitter located within the tubular cartridge and having a temperature sensing component located adjacent the body outlet, for measuring the temperature at the body outlet and for transmitting signals indicative thereof.

Most preferably, the choke valve further comprises one or more pressure transmitters for measuring the pressure across the choke valve.

DESCRIPTION OF THE PREFERRED EMBODIMENTS

Figure 1:
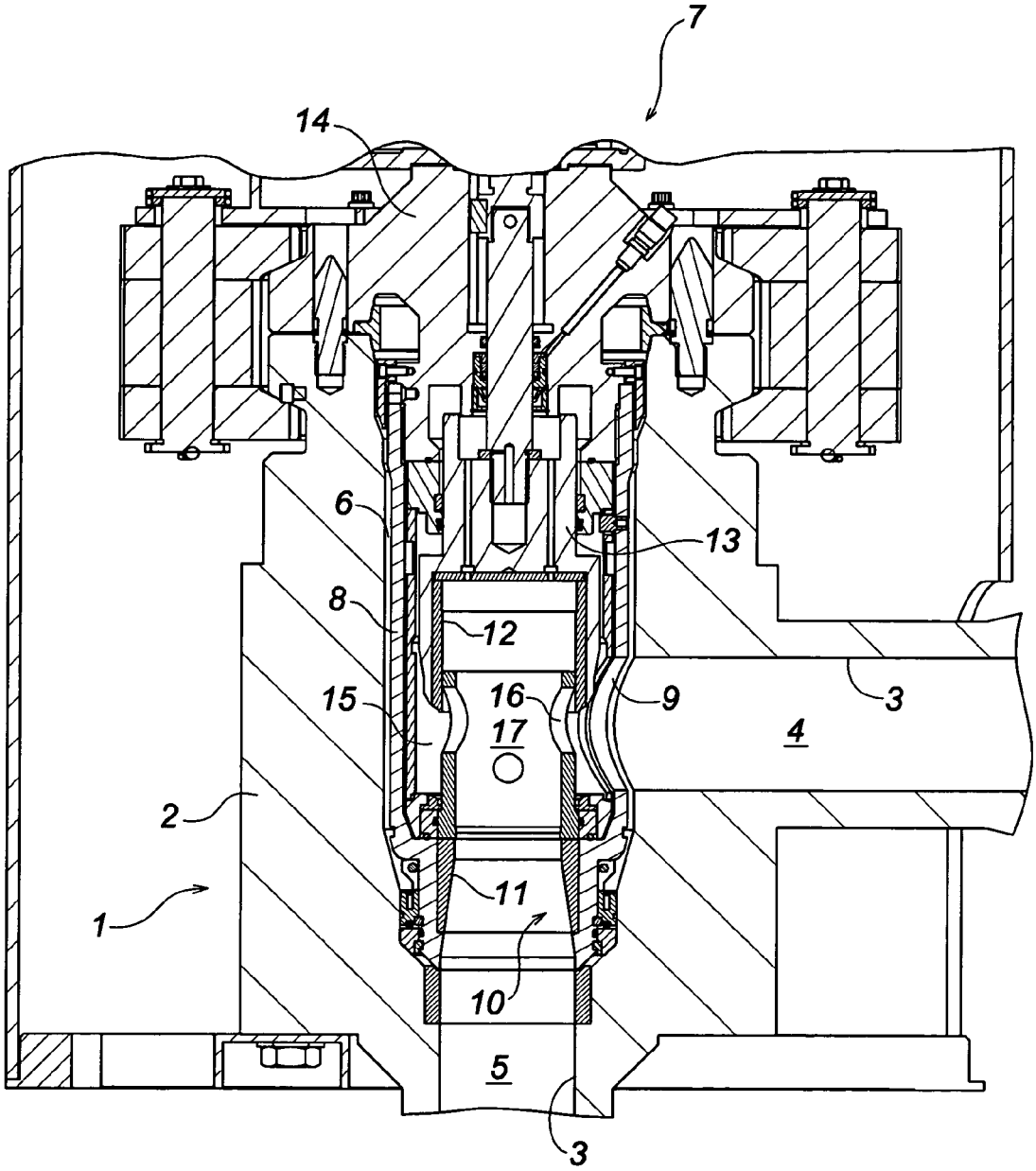
FIG. 1 (Prior Art)
FIG. 1 is a cross-sectional side view of a conventional prior art sub-sea choke valve insert installed in a choke valve body, as described above.
Figure 2:
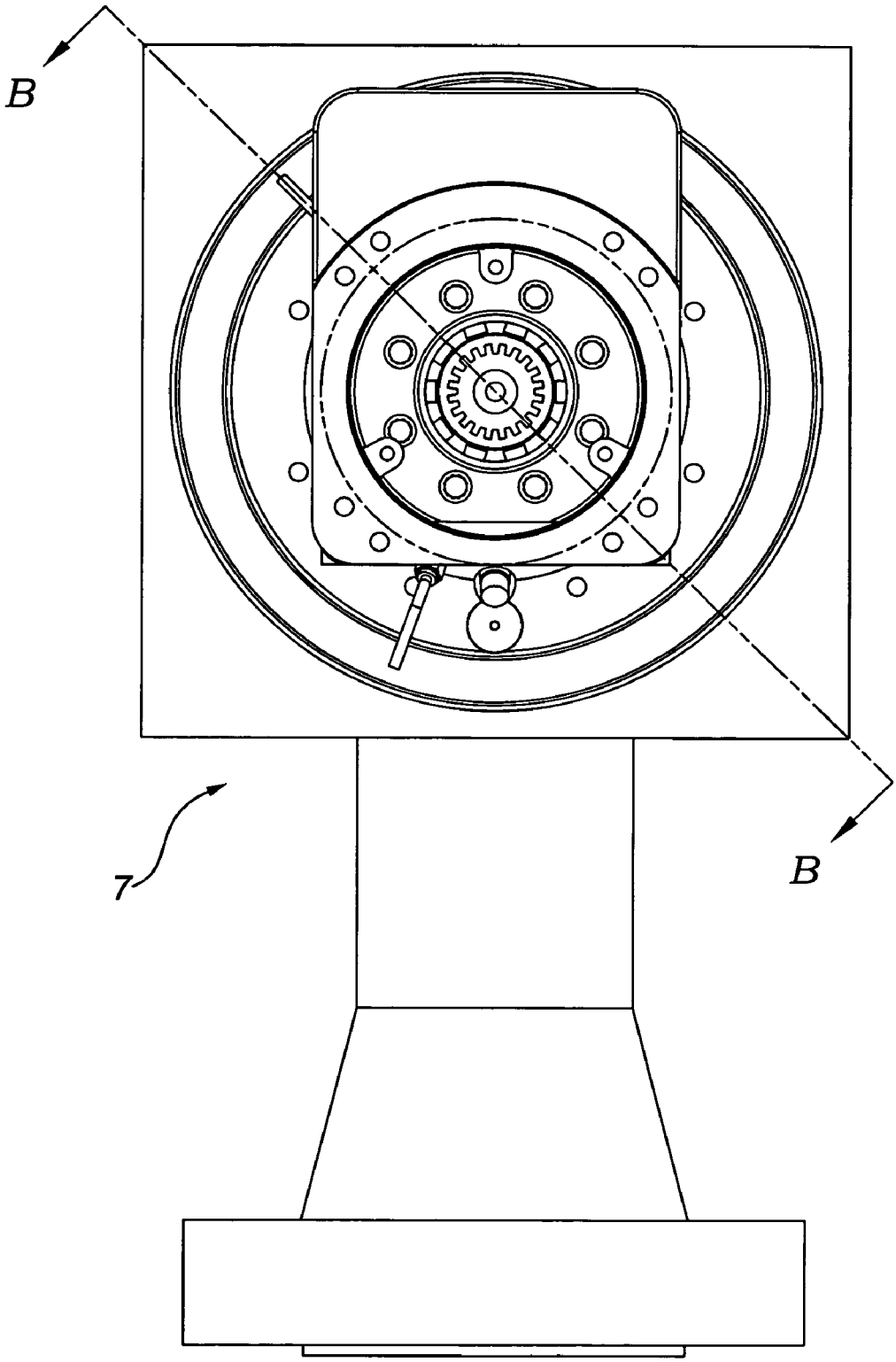
FIG. 2 is a top view of the modified choke valve of this invention, taken from the actuated end, thus viewing the choke valve from the opposite side of the outlet end.
Figure 3:
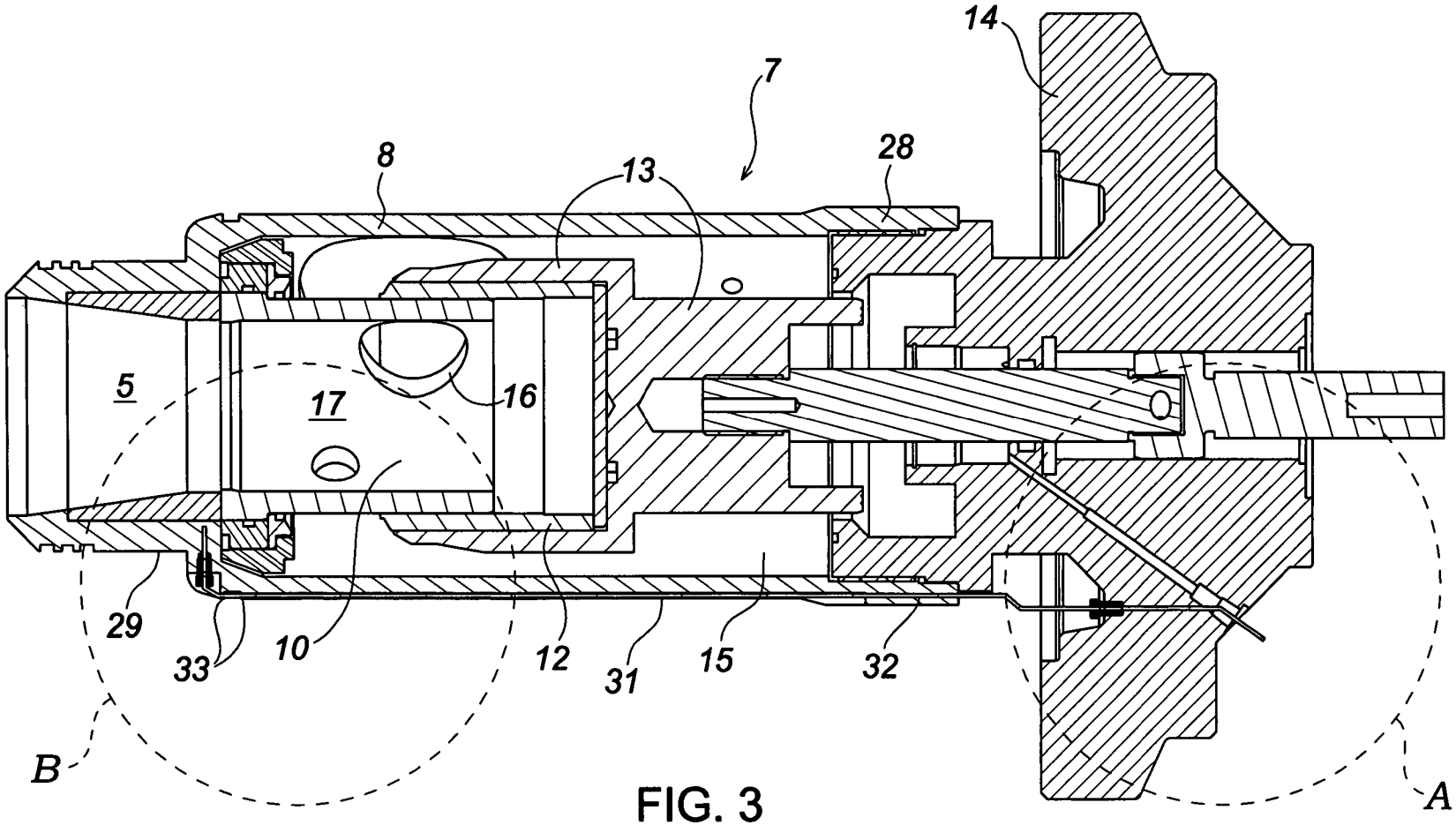
FIG. 3 is a cross-sectional side view of the valve insert portion of the modified choke valve of this invention taken along line B—B of FIG. 2, showing the downstream (outlet) temperature transmitter.
Figure 4:
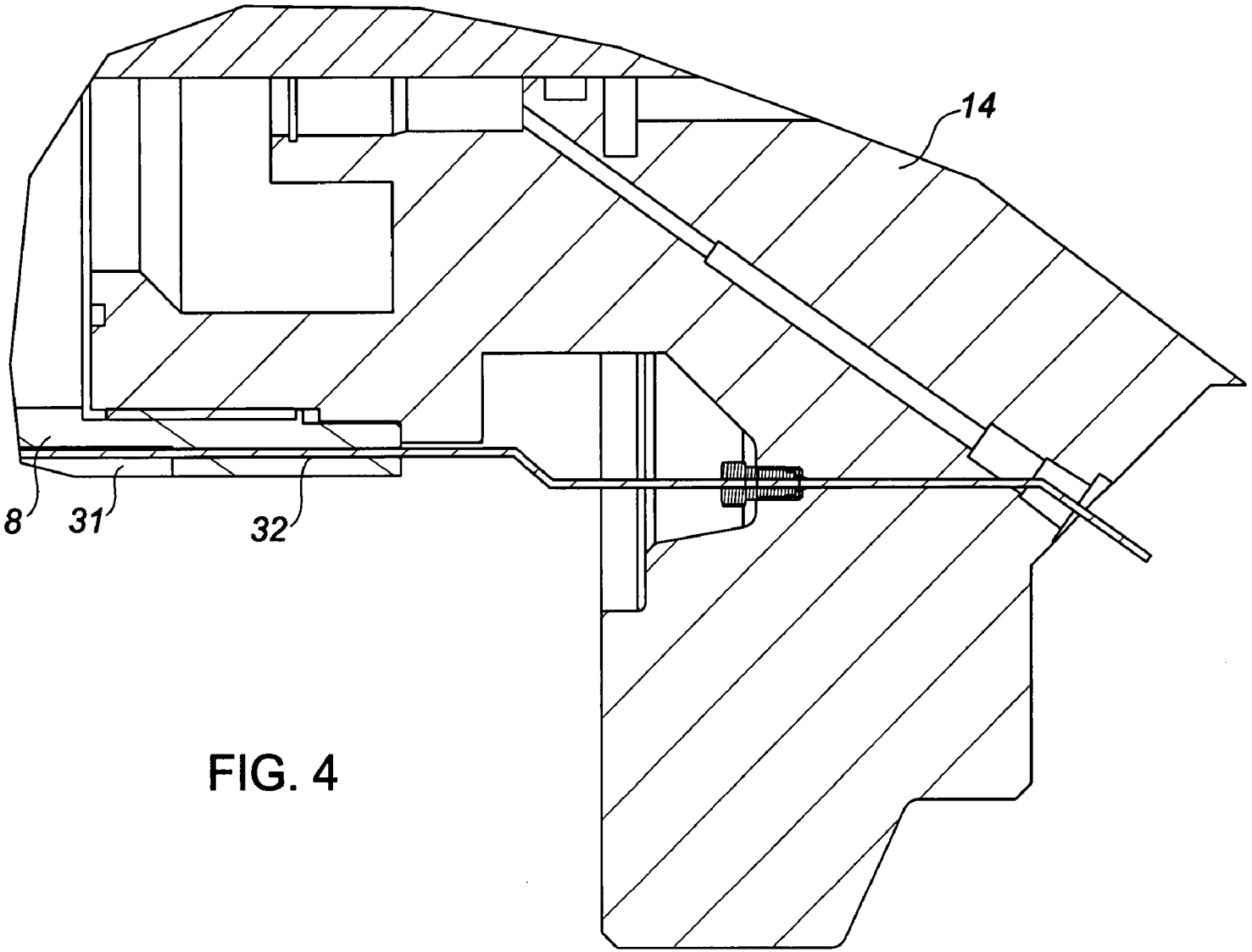
FIG. 4 is an enlarged cross-sectional view of the area A circled in FIG. 3, showing the initiation point for the downstream temperature transmitter.
Figure 5:
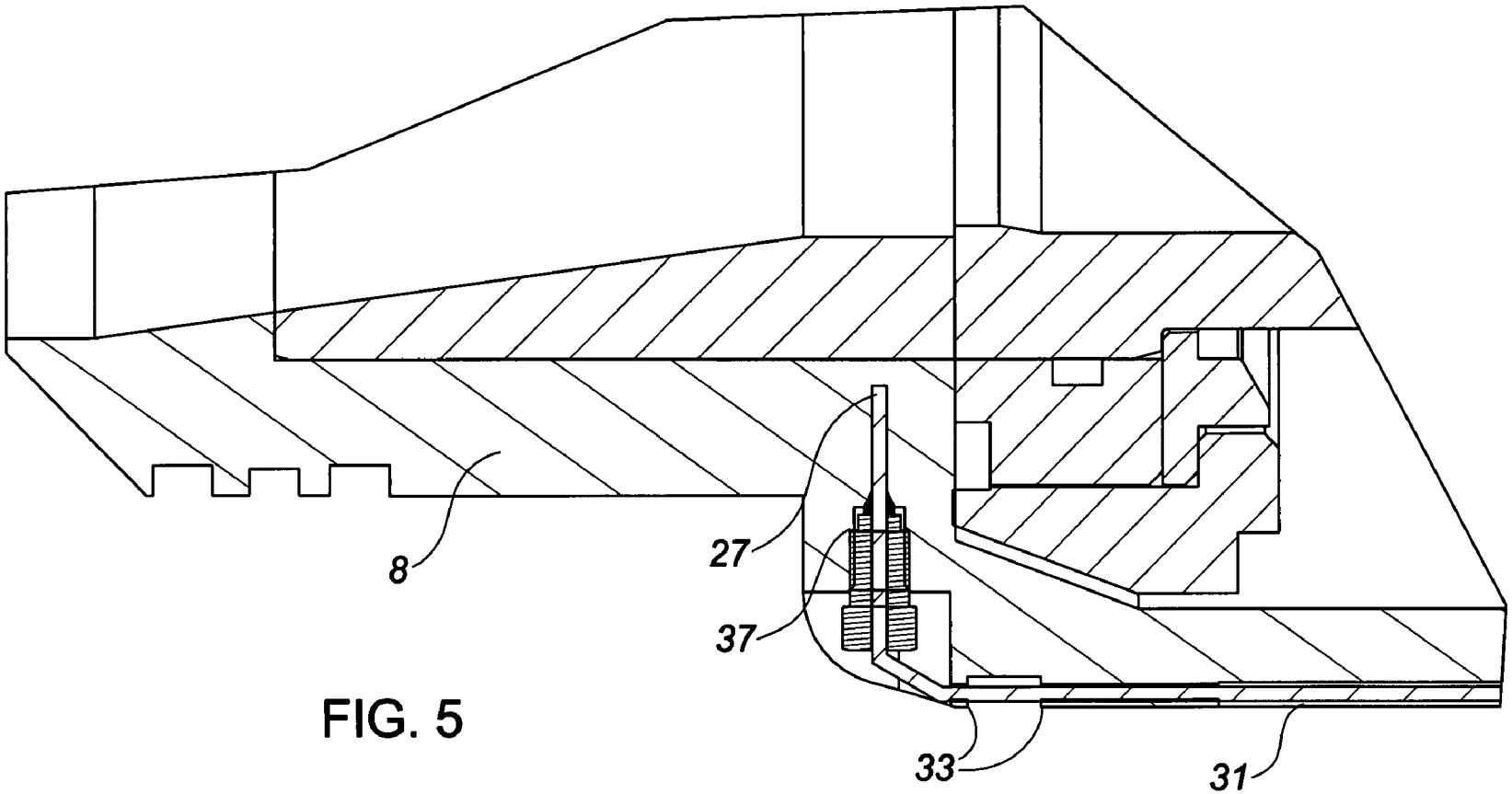
FIG. 5 is an enlarged cross-sectional view of the area B circled in FIG. 3, showing the termination point for the downstream temperature transmitter.
Figure 7:
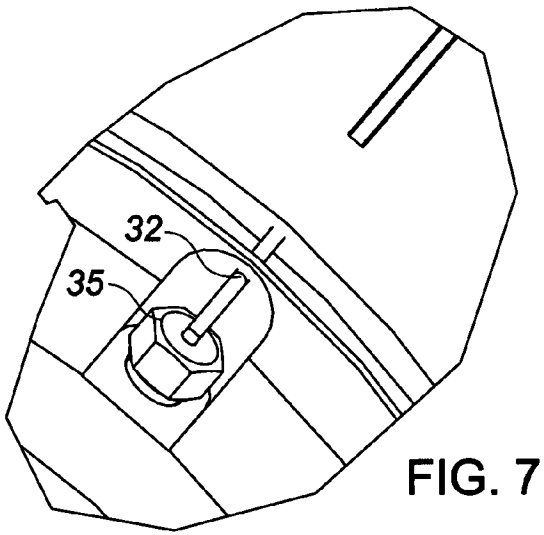
FIG. 7 is an enlarged view of area C circled in FIG. 6, showing the termination point for the downstream temperature transmitter.
Figure 8:
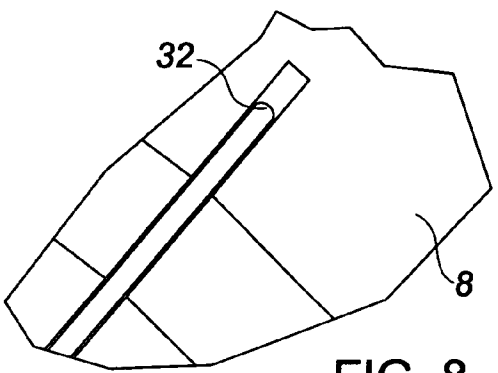
FIG. 8 is an enlarged view of the area D circled in FIG. 6, showing the initiation point for the downstream temperature transmitter.
Figure 6:
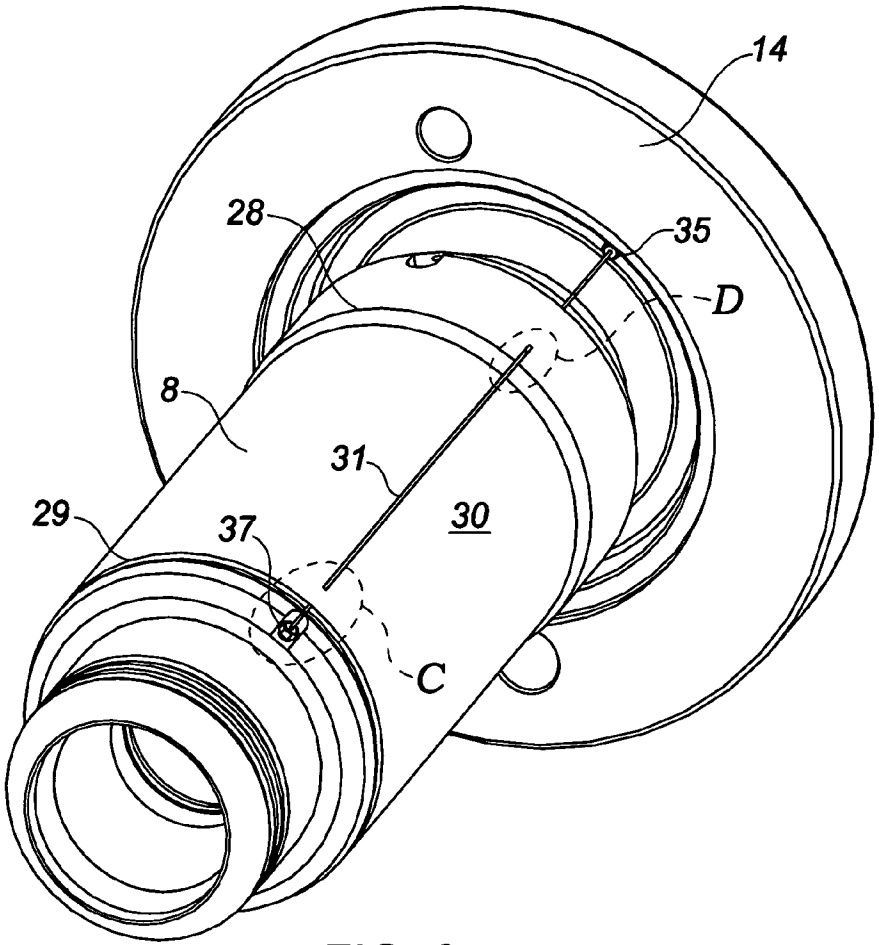
FIG. 6 is a perspective view of the valve insert of FIG. 3, taken from the outlet end, showing the placement of the downstream temperature transmitter.
Figure 9:
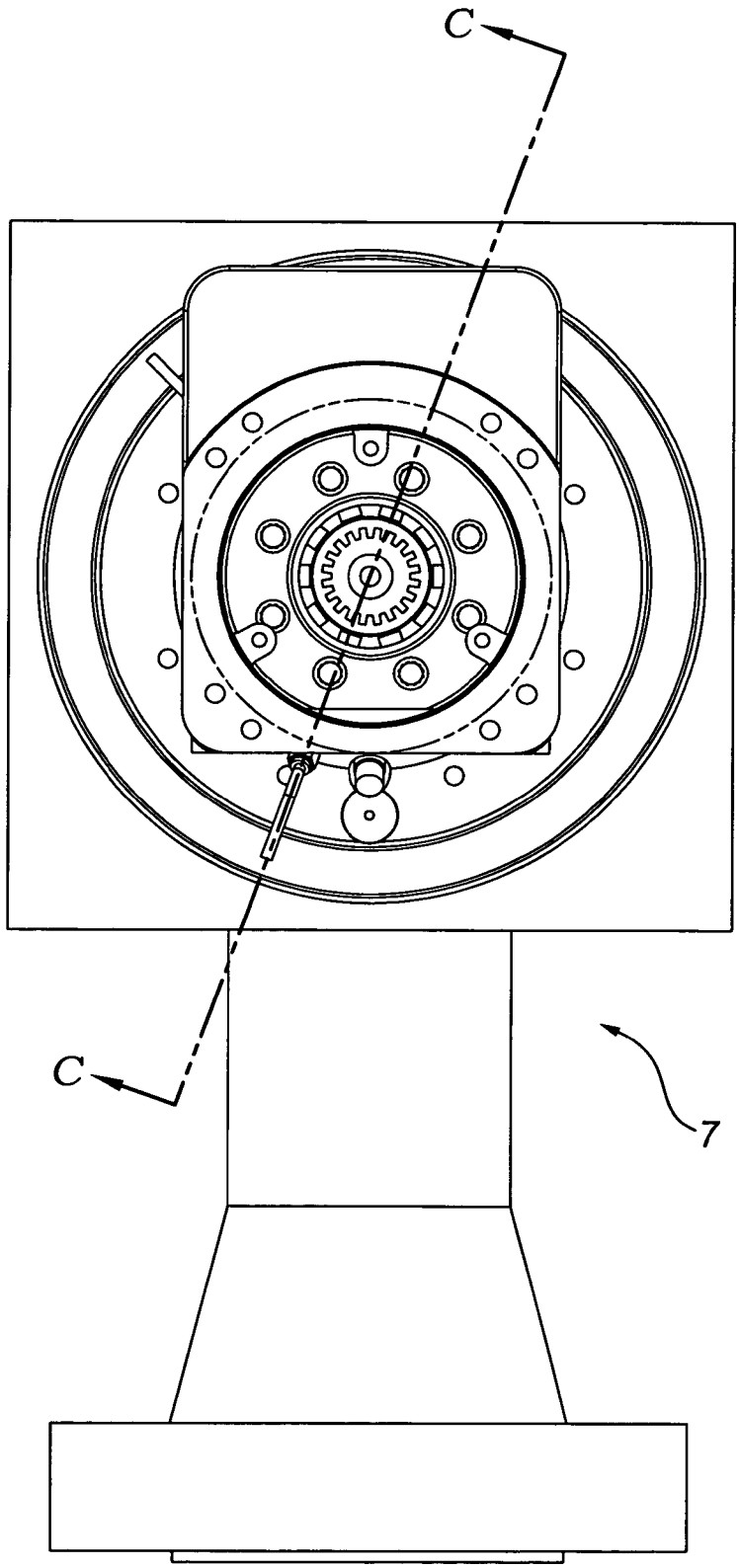
FIG. 9 is a top view of the modified choke valve of this invention, taken from the actuated end, thus viewing the choke valve from the opposite side of the outlet end, and rotated relative to FIG. 2.
Figure 10:
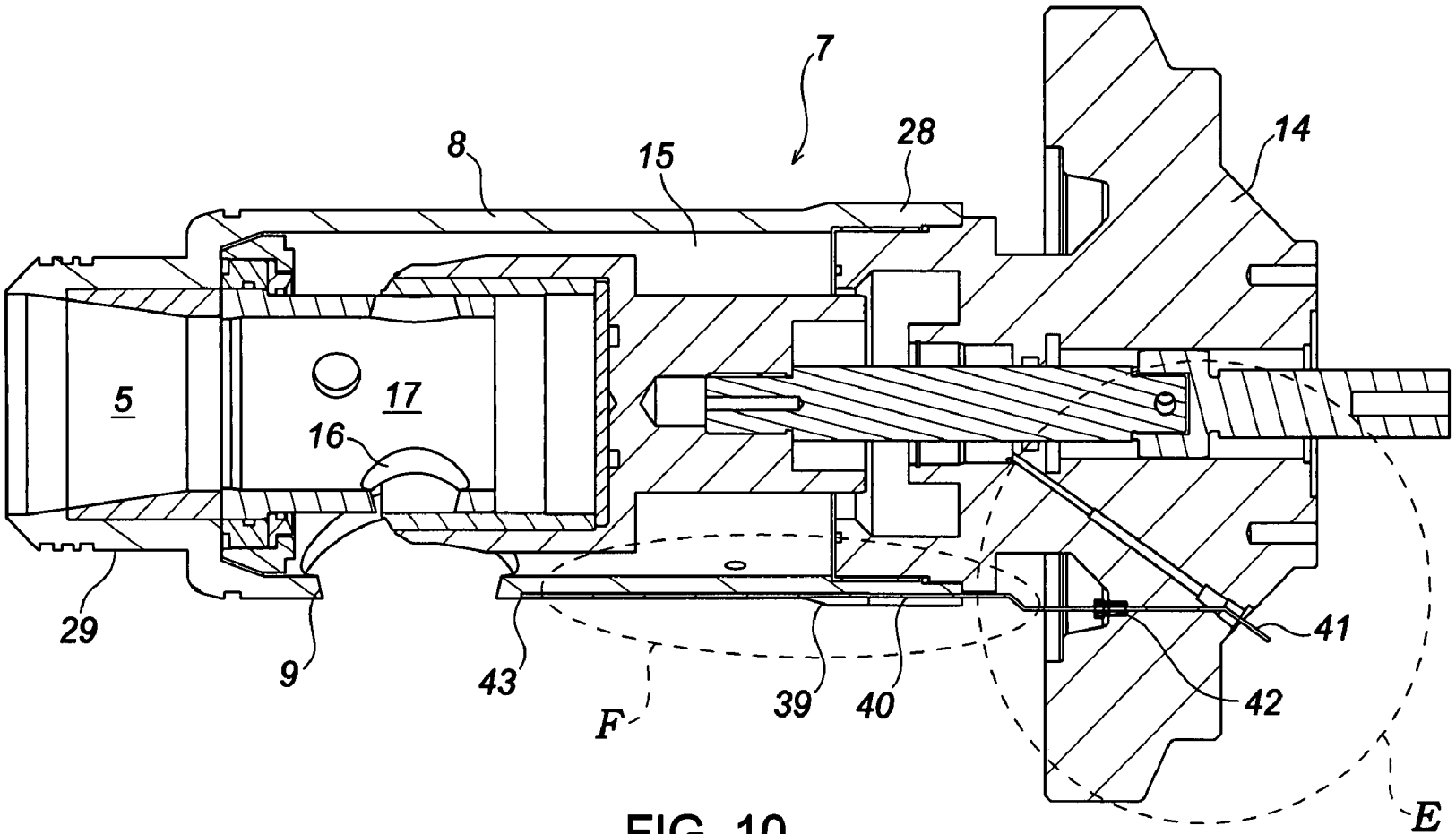
FIG. 10 is a cross-sectional side view of the valve insert portion of the modified choke valve taken along line C—C of FIG. 9, showing the upstream (inlet) temperature transmitter.
Figure 11:
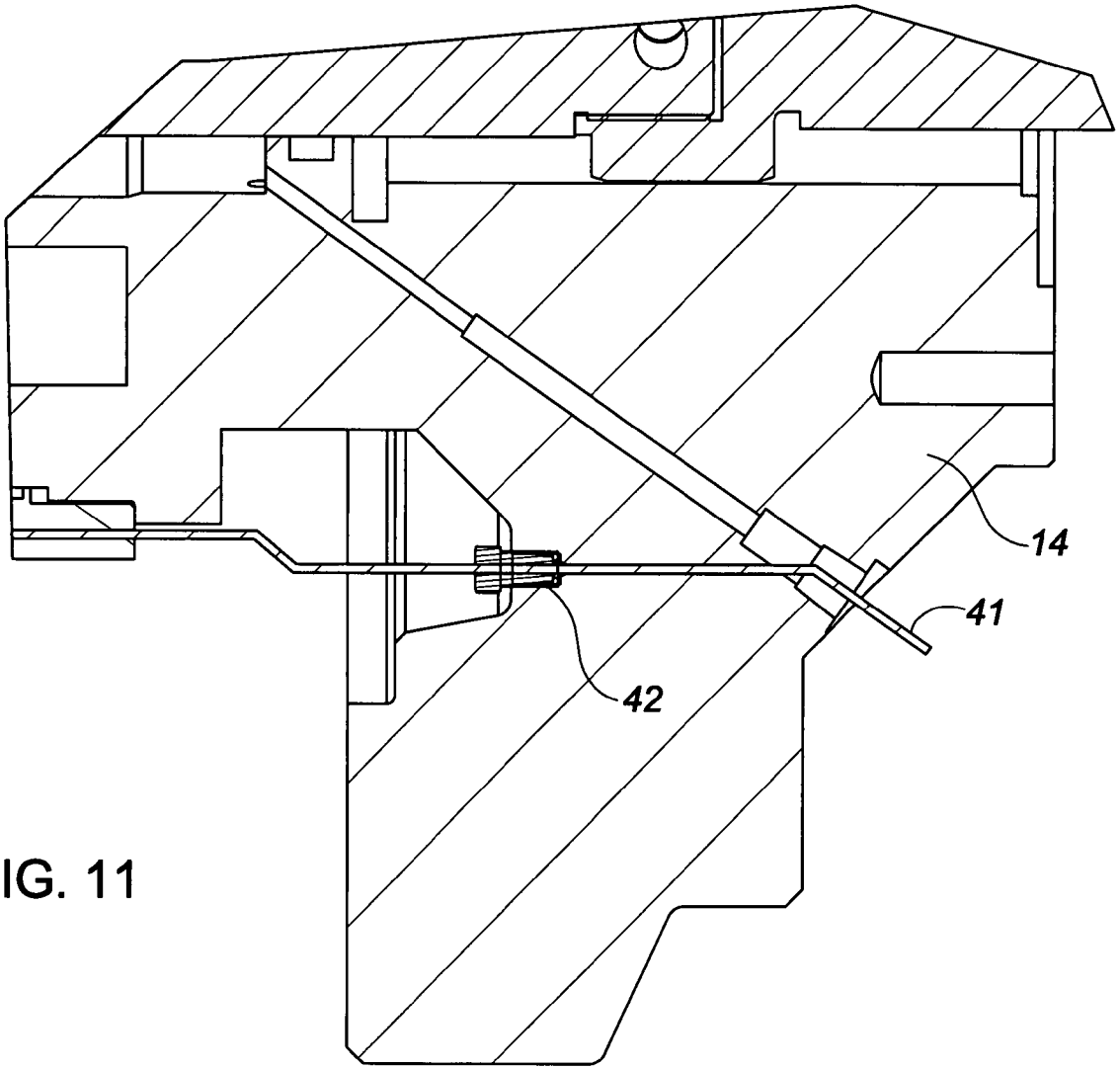
FIG. 11 is an enlarged cross-sectional view of the area E circled in FIG. 10, showing the initiation point for the upstream temperature transmitter.
Figure 12:
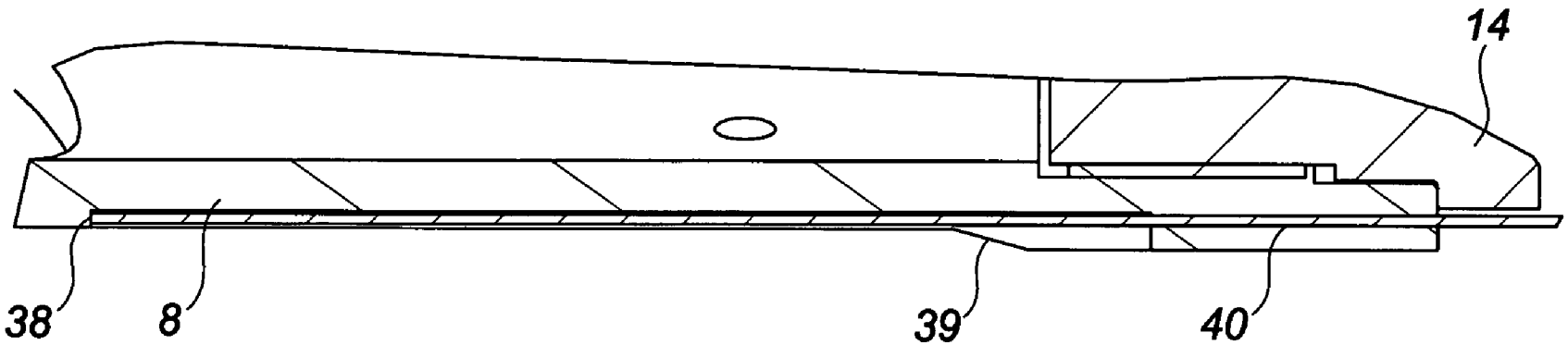
FIG. 12 is an enlarged cross-sectional view of the area F circled in FIG. 10, showing the termination point for the upstream temperature transmitter.
Figure 14:
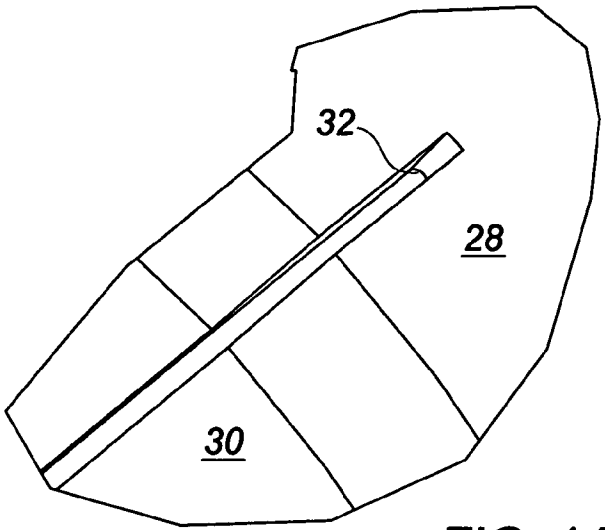
FIG. 14 is an enlarged view of the area G circled in FIG. 13, showing the detail of the upstream temperature transmitter channel.
Figure 13:
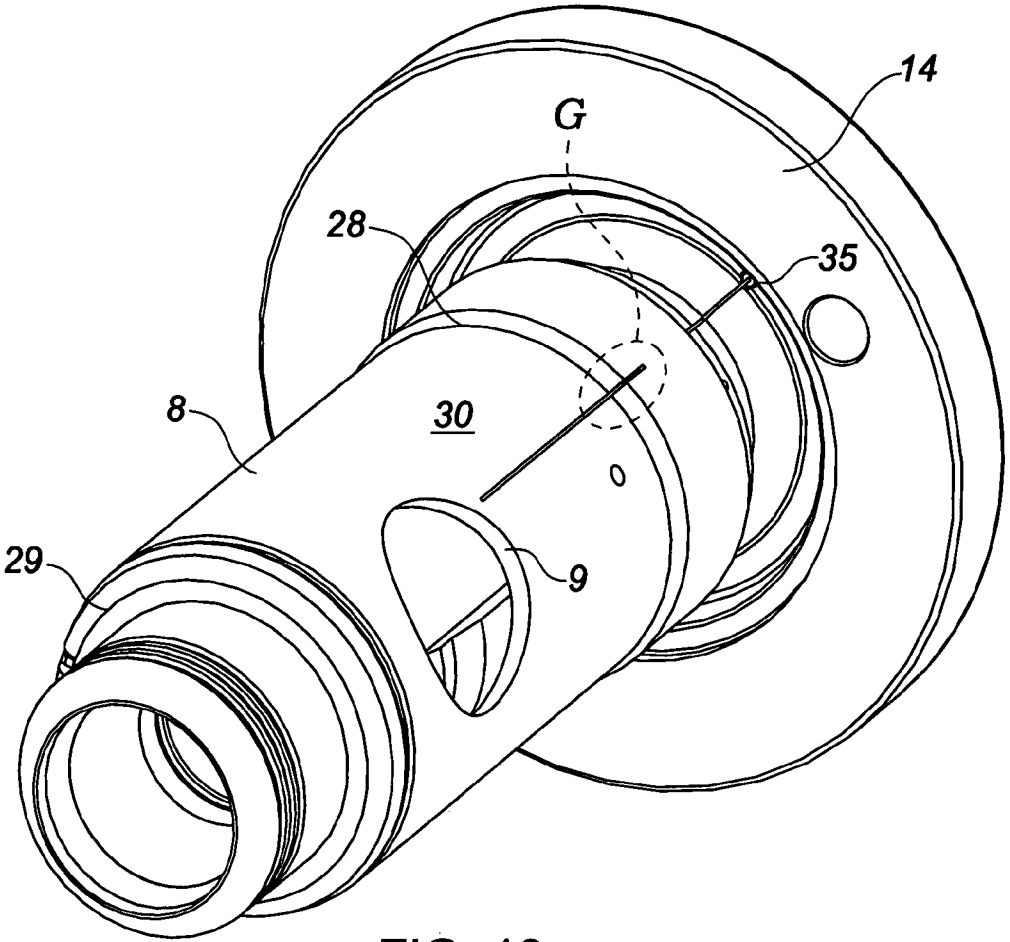
FIG. 13 is a perspective view of the valve insert of FIG. 3, taken from the outlet end, showing the placement of the upstream temperature transmitter.

Having reference to FIGS. 1–14, a choke valve 1 is described, with the main components 2–17 having been described in the Background section of this specification. FIGS. 2–14 include the details of the choke valve of this invention, showing temperature transmitters, and their placement, with respect to a preferred cage with external sleeve flow trim style choke valve. Relative to FIG. 1, FIGS. 2–14 show only the removable insert assembly 7.

The choke valve of the present invention includes at least one, and preferably two, temperature transmitters 23, 24 carried on the tubular cartridge 8, to measure and transmit temperatures at those locations on the cartridge 8. Most preferably, the invention includes an upstream temperature transmitter 23 and a downstream temperature transmitter 24, with the temperature sensors being located adjacent the body inlet and the body outlet respectively.

The temperature transmitters 23, 24 include temperature sensors 25 such as any standard temperature probe, thermocouples, resistance temperature devices (RTD's), integrated circuits, thermistors etc., with signal conducting wires that are encased in a corrosion resistant metallic sheath 26. Thus the transmitters 23, 24 are functional to both measure the temperature and convert to a signal which is transmitted to the surface for remote monitoring. Exemplary temperature transmitters are available from Conax Buffalo Technologies, Buffalo, N.Y., U.S.A.

The temperature sensors 23, 24 are carried by the cartridge 8 to predetermined locations adjacent to one or both of the body inlet 4 and the body outlet 5 or other points, most preferably directly adjacent the inlet 4 and/or outlet 5, in order to measure the temperature directly at locations within the choke valve 1, and thus provide the most reliable and useful temperature information. These metallic sheaths 26 run the length of the cartridge 8 and extend up to the wetted surface of the bonnet 14. Because the cartridge 8 is part of the retrievable insert 7 and the sensors 25 are embedded in this component, the whole temperature probe system becomes retrievable. The sheaths 26 run through high pressure metal compression fittings in order to preserve the valve bonnet environmental seal. Each sheath 26 runs though the bonnet 14 and terminates shortly after exiting the bonnet 14, thus leaving only shielded conducting wires to transmit temperature signals the remaining distance to a local receiving unit. This manner of locating the temperature transmitters 23, 24 within directly on the cartridge 8 itself also maintains the transmitters 23, 24, as far as possible, away from the eroding, high pressure fluid moving through the valve 1. Also, by locating the temperature transmitters 23, 24 on the cartridge 8, they can be easily retrieved with the rest of the choke insert 7. This ensures that they can be replaced or repaired economically by bringing the choke insert 7 to the surface.

FIGS. 2–8 show the preferred placement of the downstream temperature transmitter 24, with the sensor end 27 located in the cartridge 8 adjacent the valve body outlet 5. The cartridge 8 is shown to include a bonnet end 28 and an outlet end 29. Along the outer surface 30 of the cartridge 8, between the bonnet and outlet ends 28, 29, a first sheath channel 31 is machined away. Through holes are formed at each end of the cartridge 8 adjacent the ends of the channel 31 to form a bonnet end through hole 32 and an outlet end through hole 33. The through holes 32, 33 and the first sheath channel 31 are sized to allow the temperature transmitter 24 to be threaded therethrough. The initiation end 34 of the transmitter 24 is fastened into the bonnet 14 with an initiation end metal ferrule 35 which provides a high pressure metal compression fitting. The termination end 36 of the transmitter 24 is fastened into the outlet end 29 with a termination end metal ferrule 37, which also provides a high pressure metal compression fitting.

FIGS. 9–14 show the preferred placement of the upstream temperature transmitter 23, with the sensor end 38 located in the cartridge 8 adjacent the valve body inlet 4 at the side port 9 of the cartridge 8. Along the outer surface 30 of the cartridge 8, between the bonnet end 28 and the side port 9, a second sheath channel 39 is machined away to provide a tight fitting relationship with the sheath of the temperature transmitter 23. A bonnet end through hole 40 is formed at the bonnet end 28 of the cartridge 8 adjacent the channel 39. As above, the through hole 40 and the channel 39 are sized to allow the temperature transmitter 23 to be threaded therethrough, and thus be carried by the cartridge 8. The initiation end 41 of the transmitter 23 is fastened into the bonnet 14 with an initiation end metal ferrule 42 which provides a high pressure metal compression fitting. The termination end 43 of the transmitter 23 fits tightly in the second sheath channel 39.

The choke valve of the present invention preferably includes one or more pressure transmitters (not shown) located to measure and transmit the pressure at the choke valve in order to provide meaningful measurements to calculate the flow rate in the choke valve. The pressure transmitters are most preferably as described and as located in published U.S. patent application Ser. No. 10/060,559, published as U.S. Pat. No. 2003/0141072 on Jul. 31, 2003, and commonly owned by the assignee of this patent application.

While the present invention has been described with reference to a particular sub-sea choke valve that includes a cage with external sleeve flow trim, it has broad application to other styles of choke valves, including needle and seat flow trim, cage with internal plug flow trim and multiple port disc flow trim when in an insert retrievable configuration. All of these valves include a tubular cage or cartridge, in which the temperature transmitters can be located, as described hereinabove. Thus, it should be understood that the claims of the present invention, which refer to a tubular cartridge and external sleeve flow trim, are meant to encompass such other type of valves.

All publications mentioned in this specification are indicative of the level of skill in the art of this invention. All publications are herein incorporated by reference to the same extent as if each publication was specifically and individually indicated to be incorporated by reference.

The terms and expressions in this specification are, unless otherwise specifically defined herein, used as terms of description and not of limitation. There is no intention, in using such terms and expressions, of excluding equivalents of the features illustrated and described, it being recognized that the scope of the invention is defined and limited only by the claims which follow.

We claim:

1. A choke valve, comprising:

a) a valve body forming a bore extending therethrough which provides a body inlet, a body outlet and an insert chamber therebetween;

b) a removable insert assembly positioned in the insert chamber and comprising:

i. a tubular cartridge having a side wall forming an internal bore and having a port communicating with the body inlet, whereby high pressure fluid enters through the body inlet, ii. a bonnet connected with and closing the upper ends of the cartridge and the body, the bonnet being disengagably connected with the body, and iii. a pressure reducing flow trim positioned in the cartridge bore, the flow trim having a restrictive opening whereby fluid from the body inlet may enter the flow trim at reduced pressure and pass through the body outlet, and c) a temperature transmitter carried by the tubular cartridge, and having a temperature sensing component for measuring the temperature at a location in the tubular cartridge and for transmitting signals indicative thereof.

2. The choke valve of claim 1, which includes two temperature transmitters, a first temperature transmitter located within the tubular cartridge and having a temperature sensing component located adjacent the body inlet, for measuring the temperature at body inlet and for transmitting signals indicative thereof; and a second temperature transmitter located within the tubular cartridge and having a temperature sensing component located adjacent the body outlet, for measuring the temperature at the body outlet and for transmitting signals indicative thereof.

3. The choke valve of claim 2, wherein the first and second temperature transmitters are threaded through one or more through holes and sheath channels formed in the cartridge such that the transmitters are carried on the tubular cartridge.

4. The choke valve of claim 1, which further comprises one or more pressure transmitters for measuring the pressure across the choke valve.

5. The choke valve of claim 2, which further comprises one or more pressure transmitters for measuring the pressure across the choke valve.

6. The choke valve of claim 3, which further comprises one or more pressure transmitters for measuring the pressure across the choke valve.

7. The choke valve as set forth in claim 1, wherein:

in (a), the bore is T-shaped to provide a horizontal side inlet, a vertical bottom outlet and a vertical insert chamber;

in (b) iii, the pressure reducing flow trim comprises a tubular cage, aligned with the body outlet, and a throttling sleeve slidable over the cage, the cage having a side wall forming an internal bore and restrictive flow parts aligned with the cartridge side port and the inlet, whereby fluid from the body inlet may enter the cage bore at reduced pressure and pass through the bottom outlet, and a stem extending through the bonnet, for biasing the throttling sleeve over the cage ports.

* * * * *